US009284742B1

(12) United States Patent
Deckard et al.

(10) Patent No.: US 9,284,742 B1
(45) Date of Patent: Mar. 15, 2016

(54) DEVICE AND METHOD FOR WINTERIZING THE SKIM FILTER PORT OF AN IN-GROUND POOL

(71) Applicants: William Deckard, Richboro, PA (US); William Deckard, Jr., Royersford, PA (US)

(72) Inventors: William Deckard, Richboro, PA (US); William Deckard, Jr., Royersford, PA (US)

( * ) Notice: Subject to any disclaimer, the term of this patent is extended or adjusted under 35 U.S.C. 154(b) by 290 days.

(21) Appl. No.: 13/846,891

(22) Filed: Mar. 18, 2013

(51) Int. Cl.
*E04H 4/12* (2006.01)
*E04H 4/10* (2006.01)

(52) U.S. Cl.
CPC ..... *E04H 4/1209* (2013.01); *E04H 4/103* (2013.01); *E04H 4/105* (2013.01); *E04H 4/1272* (2013.01); *Y10T 29/4994* (2015.01); *Y10T 29/49938* (2015.01); *Y10T 29/49947* (2015.01)

(58) Field of Classification Search
CPC ..... E04H 4/1209; E04H 4/105; E04H 4/103; E04H 4/1272; Y10T 29/49947; Y10T 29/49938; Y10T 29/4994
See application file for complete search history.

(56) References Cited

U.S. PATENT DOCUMENTS 4,879,772 A 11/1989 Meloney, Jr.
5,706,530 A * 1/1998 Mariano ..... 4/496

* cited by examiner

*Primary Examiner* — John C Hong
(74) *Attorney, Agent, or Firm* — LaMorte & Associates, P.C.

(57) ABSTRACT

A device and method for preventing water from gathering within the vertical well of the skim filter port of a swimming pool filtration system. A plug assembly is provided that has an expandable body and a shaft that extends below the expandable body. The plug assembly is inserted into the vertical well of a pool's skim filter port. The shaft under the expandable body is mechanically interconnected to the intake port within the vertical well. The expandable body is then expanded within the vertical well by being either vertically compressed or internally inflated. The expandable body fills the vertical well and prevents any significant amounts of water from collecting in the vertical well.

9 Claims, 9 Drawing Sheets

DEVICE AND METHOD FOR WINTERIZING THE SKIM FILTER PORT OF AN IN-GROUND POOL

BACKGROUND OF THE INVENTION

1. Field of the Invention

In general, the present invention relates to plug devices that are used to temporarily obstruct the skim filter ports of swimming pools. More particularly, the present invention relates to plug devices that are used in the winter to prevent water from gathering and freezing in the skim filter ports of a swimming pool.

2. Prior Art Description

In-ground pools that are used for swimming typically have a filter system with filter intakes both at the bottom of the pool and at the surface of the pool. Filter intakes at the bottom of the pool filter out dirt and debris that sinks to the bottom of the pool. The filter intakes at the surface of the pool filter out dirt and debris that may float near or at the top of the pool. The filter intakes at the surface of the pool often take the form of a skim filter port.

A typical prior art skim filter port is shown in FIG. 1. Referring to FIG. 1, it can be seen that the skim filter port 10 has a horizontal opening 12 that is exposed to the water 14 within the pool 16. The water level in the pool 16 is kept at the same level as the horizontal opening 12. As such, any dirt near or at the surface of the water 14 can be drawn into the horizontal opening 12.

The horizontal opening 12 leads to a vertical well 20 that is formed in the pool deck 18, adjacent the pool 16. The pool's filters draw in water from the bottom of the vertical well 20. A filter basket 22 is placed in the vertical well 20. The filter basket 22 catches sticks, leaves and other large objects and prevents those objects from being drawn into the primary pool filters. The filter basket 22 can be removed from the top of the vertical well 20. The vertical well 20 has an open top 24. The open top 24 is covered by a removable lid 26. To access the filter basket 22, the lid 26 is removed and the filter basket 22 is lifted out of the open top 24 of the vertical well 20.

The bottom of the vertical well 20 is connected to a pipe intake port 28. The pipe intake port 28 leads to the primary filters of the pool 16. A plug assembly 30 is provided. The plug assembly has a threaded bolt 33, and elastomeric plug body 31 and a wing nut 32. The plug assembly 30 is used to temporarily obstruct the pipe intake port 28 when the primary filter of the pool 16 is removed or otherwise undergoing maintenance. This is done by inserting the plug assembly 30 into the pipe intake port 28. The wing nut 32 is then turned to compress and expand the elastomeric plug body 31. This seals the pipe intake port 28.

Many in-ground swimming pools are located in geographic areas that experience temperatures that are below freezing during the winter months. If the skim filter ports 10 are left unprotected during the winter months, any water in the skim filter ports 10 can freeze. As water freezes it expands. As such, the frozen water can crack the vertical well 20, the horizontal opening 12 and/or the pipe intake port 28.

In order to prepare a pool 16 for winter, many people attempt to winterize their pools by plugging the vertical well 20 of the skim filter port 10 with various objects. The most common objects are empty bottles and blocks of wood. The problem with such objects is that they do not neatly fit the shape of the vertical well 20. Consequently, rain water is capable of passing around the object and collecting at the bottom of the vertical well 20. As the water collects at the bottom of the vertical well 20, it can lift the buoyant bottle or wood block up out of the vertical well 20, therein allowing for the admittance of even more water. Soon enough water becomes present that can cause damage as it freezes.

In the prior art, devices have been designed to keep water out of a skim filter port. However, such devices tend to be custom shaped to a particular model of skim filter port. As such, they cannot be mass produced for any and all in-ground pools. Furthermore, such prior art devices tend to be difficult and complex to install. Often, such prior art devices extend out of the horizontal opening of a skim filter port. This could prevent a pool's cover from properly seating around the top of the pool. In addition, the prior art devices do not engage the bottom of the vertical well. In this manner, the prior art devices are susceptible to buoyant displacement as water collects at the bottom of the vertical wells. Such prior art devices are exemplified by U.S. Pat. No. 4,879,772 to Meloney, entitled, Device For Closing Off A Pool Skimmer.

A need therefore exists for a device that can prevent water from collecting in a skim filter port that is capable of fitting a wide variety of skim filter port models, is easy to install, and is immune to the problems of buoyant displacement. These needs are met by the present invention as described and claimed below.

SUMMARY OF THE INVENTION

The present invention is a device and method for preventing water from gathering within the vertical well of the skim filter port of a swimming pool filtration system.

A plug assembly is provided that has an expandable body and a shaft that extends below the expandable body. The plug assembly is inserted into the vertical well of a pool's skim filter port. The shaft under the expandable body is engaged with the intake port within the vertical well, therein mechanically interconnecting the plug assembly to the inside of the vertical well. This can be done by engaging the threaded shaft to a port plug placed within the intake port, provided the threaded shaft and port plug align.

The expandable body is then expanded within the vertical well by being either vertically compressed or internally inflated. The expandable body fills the vertical well and prevents any significant amounts of water from collecting in the vertical well.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
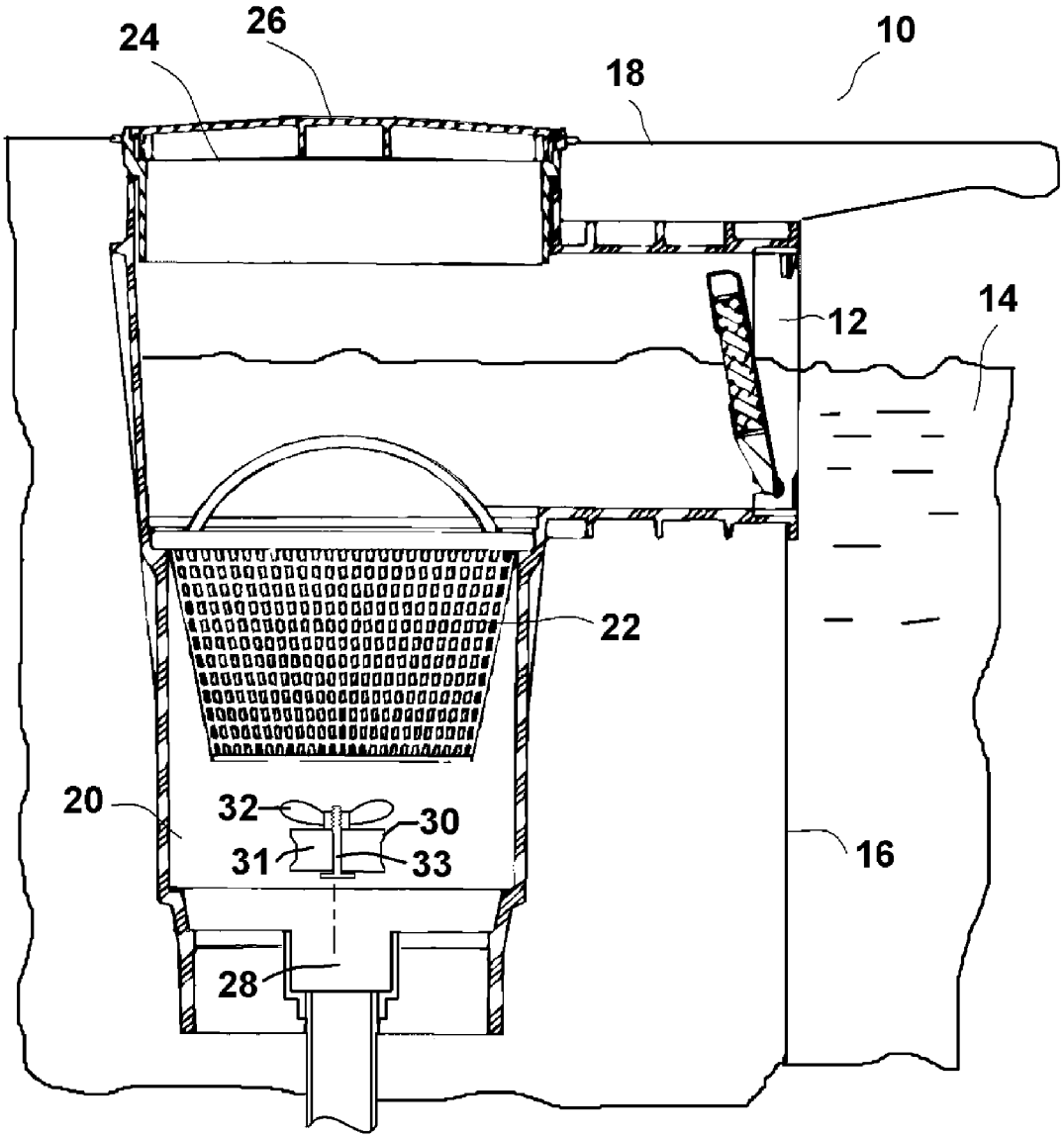
FIG. 1 (Prior Art)
FIG. 1 is a cross-sectional view of a prior art skim filter port.

Although the present invention device and method can be used to plug a variety of skim ports in pools, ponds and other manmade bodies of water, the illustrated embodiments show the device being used to plug the prior art skim filter port presented in FIG. 1. These embodiments are selected in order to set forth the best modes contemplated for the invention. The illustrated embodiments, however, are merely exemplary and should not be considered a limitation when interpreting the scope of the appended claims.

Figure 2:
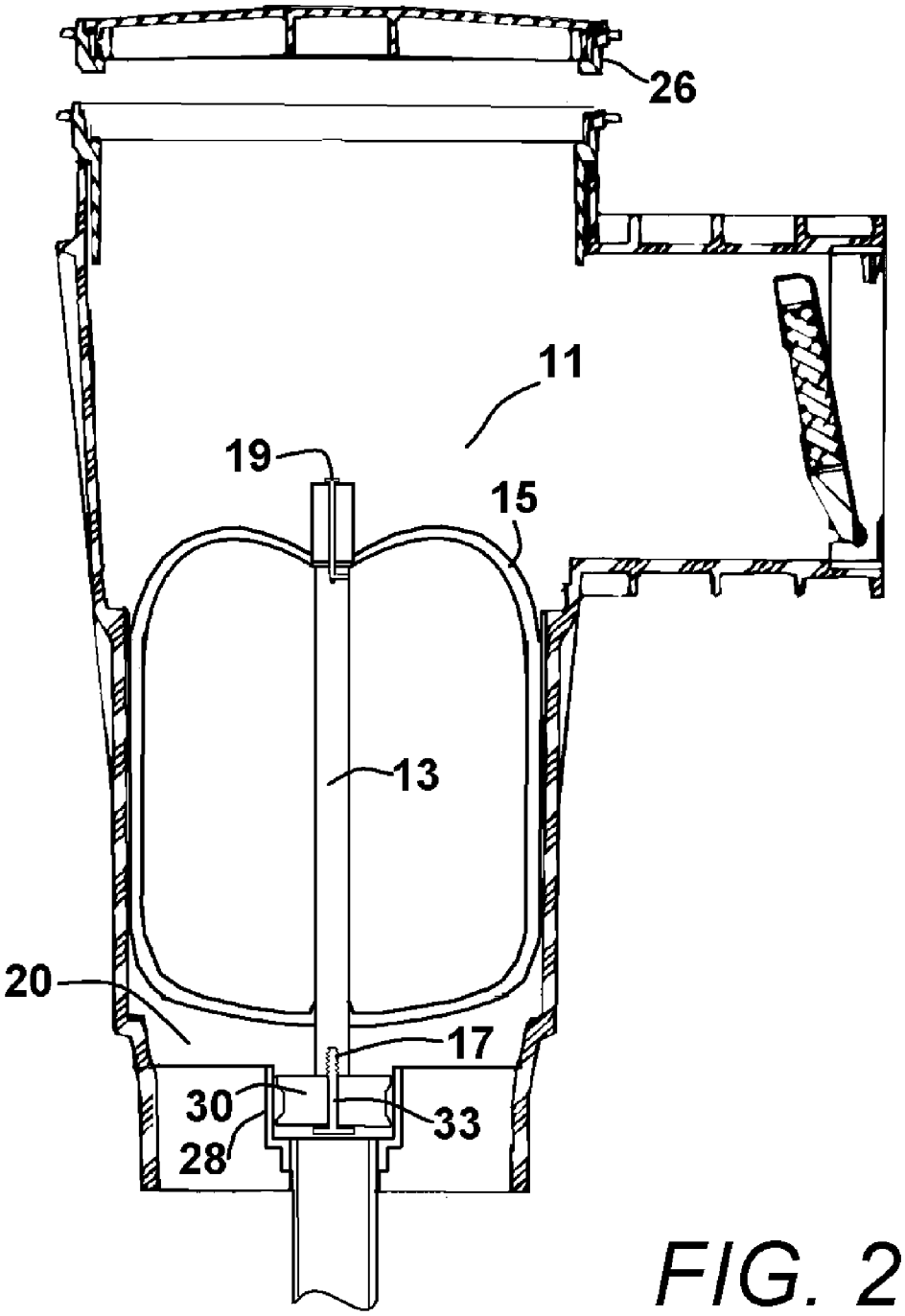
FIG. 2 is a view of a first embodiment of a plug device shown in conjunction with the prior art skim filter port of FIG. 1.
Figure 3:
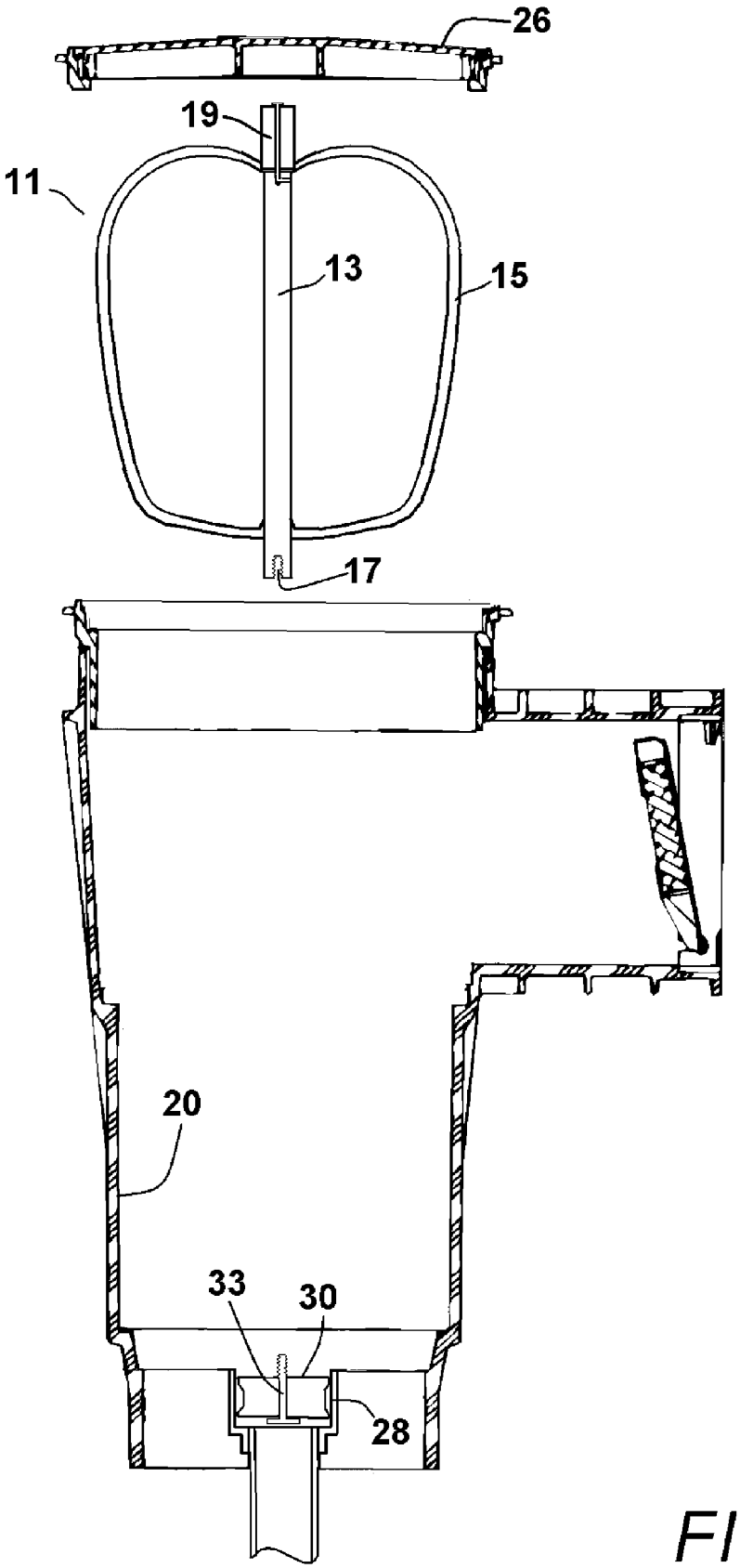
FIG. 3 is a view of the first embodiment of FIG. 2 engaging the prior art skim filter port.

Referring to FIG. 2 and FIG. 3 in conjunction with reference to the prior art environment of FIG. 1, a plug device 11 is shown. The plug device 11 has a central shaft 13. the central shaft 13 has a top end and a bottom end. A section of the central shaft 13 is surrounded by an inflatable bladder 15. The inflatable bladder 15 has a length and a maximum inflated diameter. The maximum inflated diameter is wider than the interior diameter of the vertical well 20 of the skim port filter 10. The inflatable bladder 15 is preferably made of a high strength synthetic rubber or silicon material that enables the plug device 11 to remain flexible even in sub-freezing temperatures. However, even when inflated, the top end and the bottom end of the central shaft 13 extends beyond the inflatable bladder 15.

A threaded bore 17 is formed in the bottom end of the central shaft 13. The threaded bore 17 is sized to engage the bolt 33 of the prior art plug assembly 30. An inflation nipple 19 is also provided. The inflation nipple 19 extends through the top end of the central shaft 13 and enables the inflatable bladder 15 to be inflated with an external air pump.

In order to install the plug device 11, the lid 26 of the skim filter port 10 is removed, as is the internal filter basket 22. The plug device 11 is inserted into the vertical well 20 until the threaded bore 17 at the bottom of the central shaft 13 engages the bolt 33 of the elastomeric plug assembly 30. The elastomeric plug assembly 30 is positioned in the pipe intake port 28. The top end of the central shaft 17 is then manually turned to thread the central shaft 13 onto the elastomeric plug assembly 30. This causes the elastomeric plug assembly 30 to expand and plug the pipe intake port 28.

Once the central shaft 13 is engaged with the pipe intake port 28, the inflatable bladder 15 is inflated by adding air through the inflation nipple 19. As the inflatable bladder 15 expands, it fills the vertical well 20. As such, little or no water is capable of filling the vertical well 20. If any water were to enter the vertical well 20, that water would have very little volume because there is no area into which the water could flow and rest. If any water were to make it under the plug device 11, that water could not float the plug device 11 out of the vertical well 20 because the plug device 11 is mechanically engaged with the pipe intake port 28 at the bottom of the vertical well 20.

The result is a plug device 11 that conforms to the shape of many different skim filter ports. Furthermore, the plug device 11 is mechanically engaged with the pipe intake port 28 at the bottom of the vertical well 20. This prevents the plug device 40 from being buoyantly displaced from the vertical well 20 even if the entire skim filter port 10 were submerged in rainwater or floodwater. Lastly, the plug device 11 is easily installed by simply threading the central shaft 13 at the bottom of the plug device 11 to the elastomeric stop assembly 30 as the elastomeric stop assembly is set into the pipe intake port 28 at the bottom of the vertical well 20.

Figure 4:
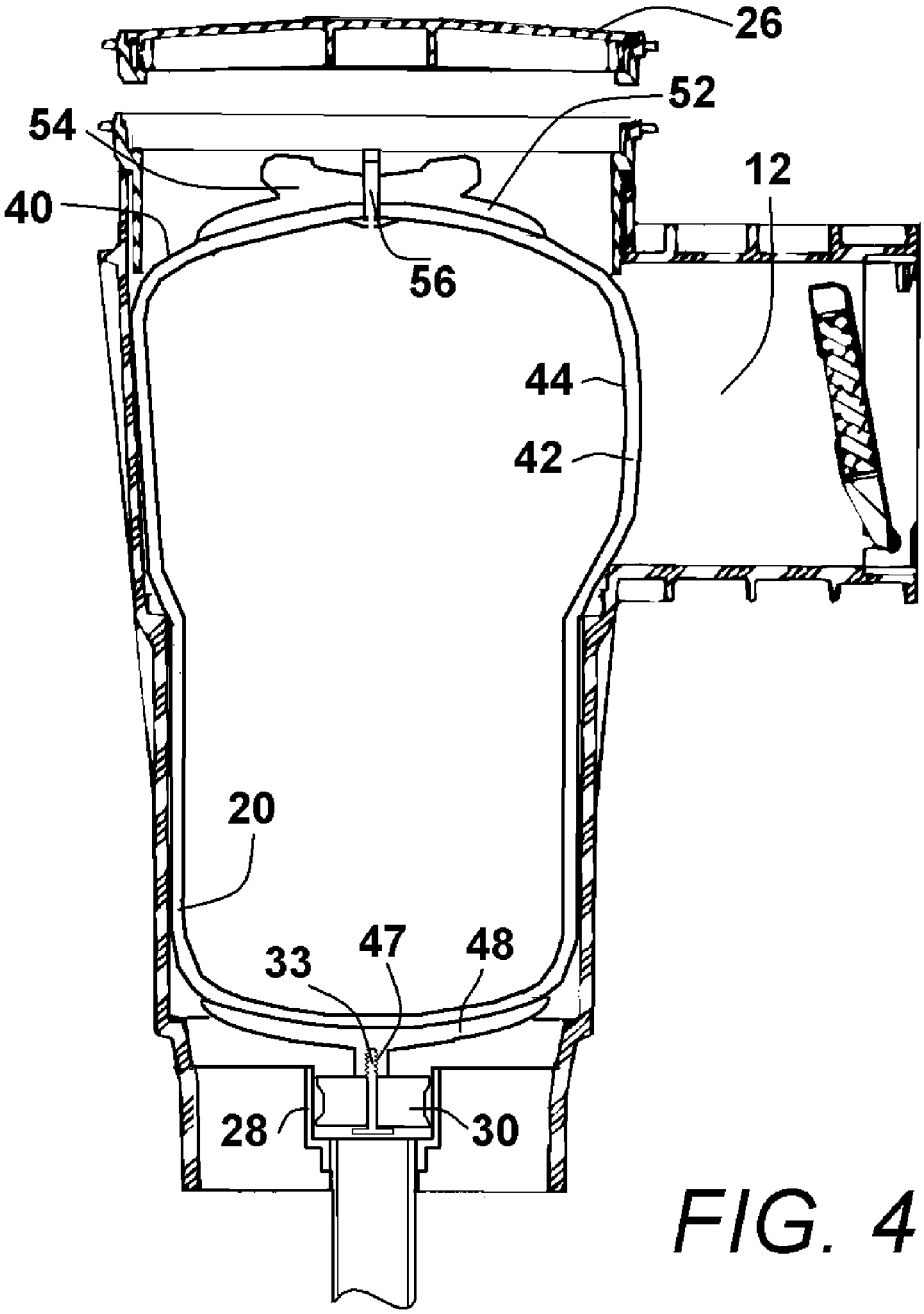
FIG. 4 is a view of a second embodiment of a plug device shown in conjunction with the prior art skim filter port of FIG. 1.
Figure 5:
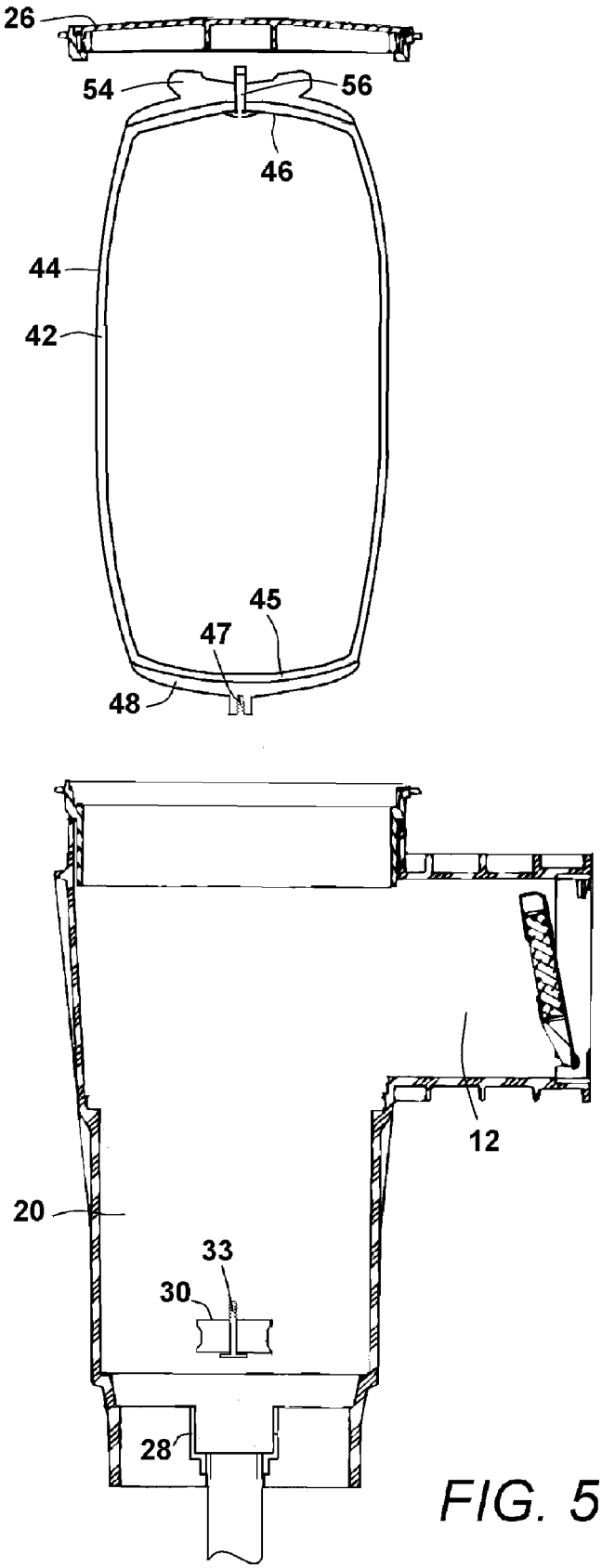
FIG. 5 is a view of the second embodiment of FIG. 4 engaging the prior art skim filter port.

Referring to both FIG. 4 and FIG. 5, a plug device 40 is shown. The plug device 40 has an expandable body 42. In the shown embodiments, the expandable body 42 takes the form of an inflatable bladder 44. The inflatable bladder 44 has a length and a maximum inflated diameter. The maximum inflated diameter is wider than the interior diameter of the vertical well 20 of the skim port filter 10. The inflatable bladder 44 is preferably made of a high strength synthetic rubber or silicon material that enables the plug device 40 to remain flexible even in sub-freezing temperatures.

The inflatable bladder 44 has a bottom end 45 and a top end 46. An end plate 48 is affixed to the bottom end 45 of the inflatable bladder 44. A threaded bore 47 is formed in the center of the end plate 48. The end plate 48 can be adhesively bonded and/or heat bonded to the inflatable bladder 44 so as to remain affixed to the inflatable bladder 44 regardless of its degree of inflation.

The threaded bore 47 on the end plate 48 engages the bolt 33 of the elastomeric plug assembly 30. As the end plate 48 turns, it tightens on the bolt 33 and causes the elastomeric plug assembly 30 to expand and seal the pipe intake port 28 at the bottom of the vertical well 20.

A top plate 52 is affixed to the top end 46 of the inflatable bladder 44. The top plate 52 includes a handle element 54 that enables the top plate 52 to be easily manually grasped. An inflation nipple 56 is also provided. The inflation nipple 56 extends through the top plate 52.

In order to install the plug device 40, the lid 26 of the skim filter port 10 is removed, as is the internal filter basket 22. The plug device 40 is partially inflated so as not to be flaccid. The plug device 40 is inserted into the vertical well 20 until the threaded bore 47 at the bottom of the plug device 40 engages the elastomeric plug assembly 30 in the pipe intake port 28. The handle element 54 on the top plate 52 is then manually turned to thread the threaded bore 47 onto the elastomeric plug assembly 30.

Once the threaded bore 47 engages the elastomeric plug assembly 30 and expands the elastomeric plug assembly 30 into the pipe intake port 28, the inflatable bladder 44 is inflated by adding air through the inflation nipple 56. As the inflatable bladder 44 expands, it fills the vertical well 20 and plugs the horizontal opening 12. As such, little or no water is capable of filling the vertical well 20. If any water were to enter the vertical well 20, that water would have very little volume because there is no area into which the water could flow and rest. If any water were to make it under the plug device 40, that water could not float the plug device 40 out of the vertical well 20 because the plug device 40 is mechanically engaged with the pipe intake port 28 at the bottom of the vertical well 20.

The result is a plug device 40 that conforms to the shape of many different skim filter ports. Furthermore, the plug device 40 is mechanically engaged with the pipe intake port 28, via the elastomeric plug assembly 30. This prevents the plug device 40 from being buoyantly displaced from the vertical well 20 even if the entire skim filter port 10 were submerged in rainwater or floodwater. Lastly, the plug device 40 is easily installed by simply threading the threaded bore 47 at the bottom of the plug device 40 into the elastomeric plug assembly 30 at the bottom of the vertical well 20.

Figure 6:
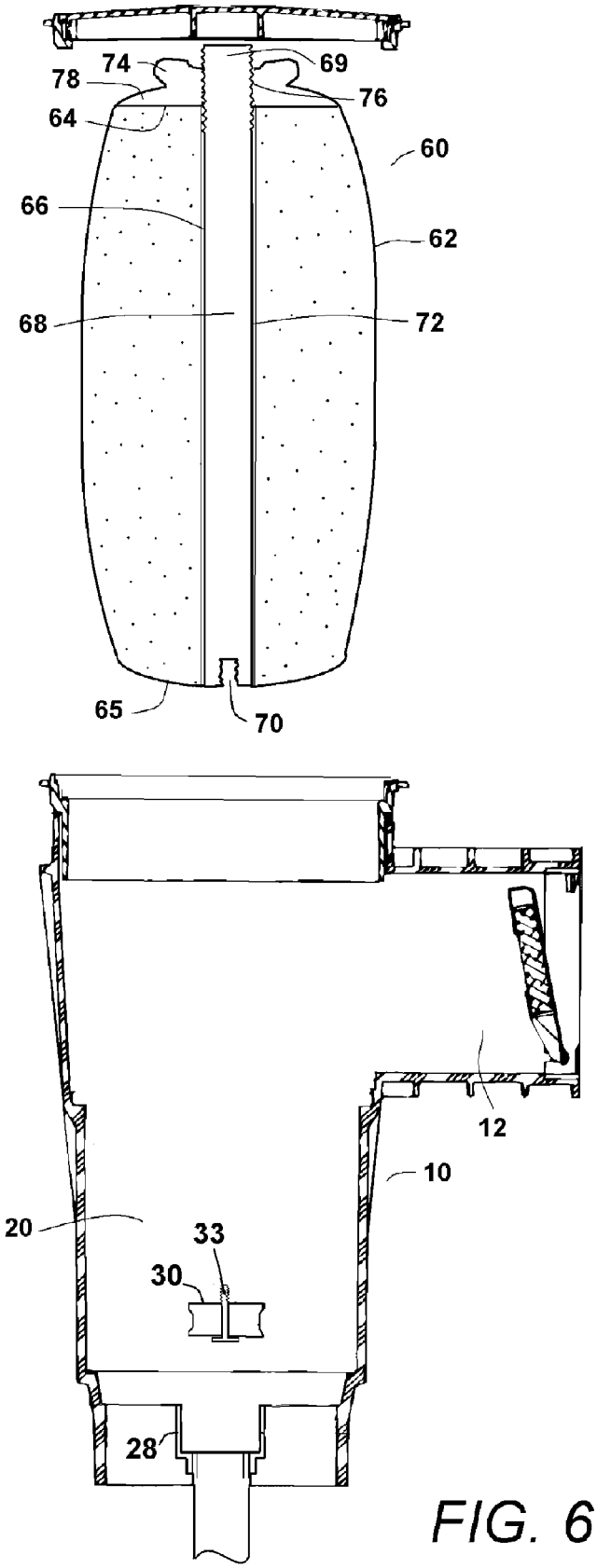
FIG. 6 is a cross-sectional view of a third embodiment of a plug device shown in conjunction with the prior art skim filter port of FIG. 1.
Figure 7:
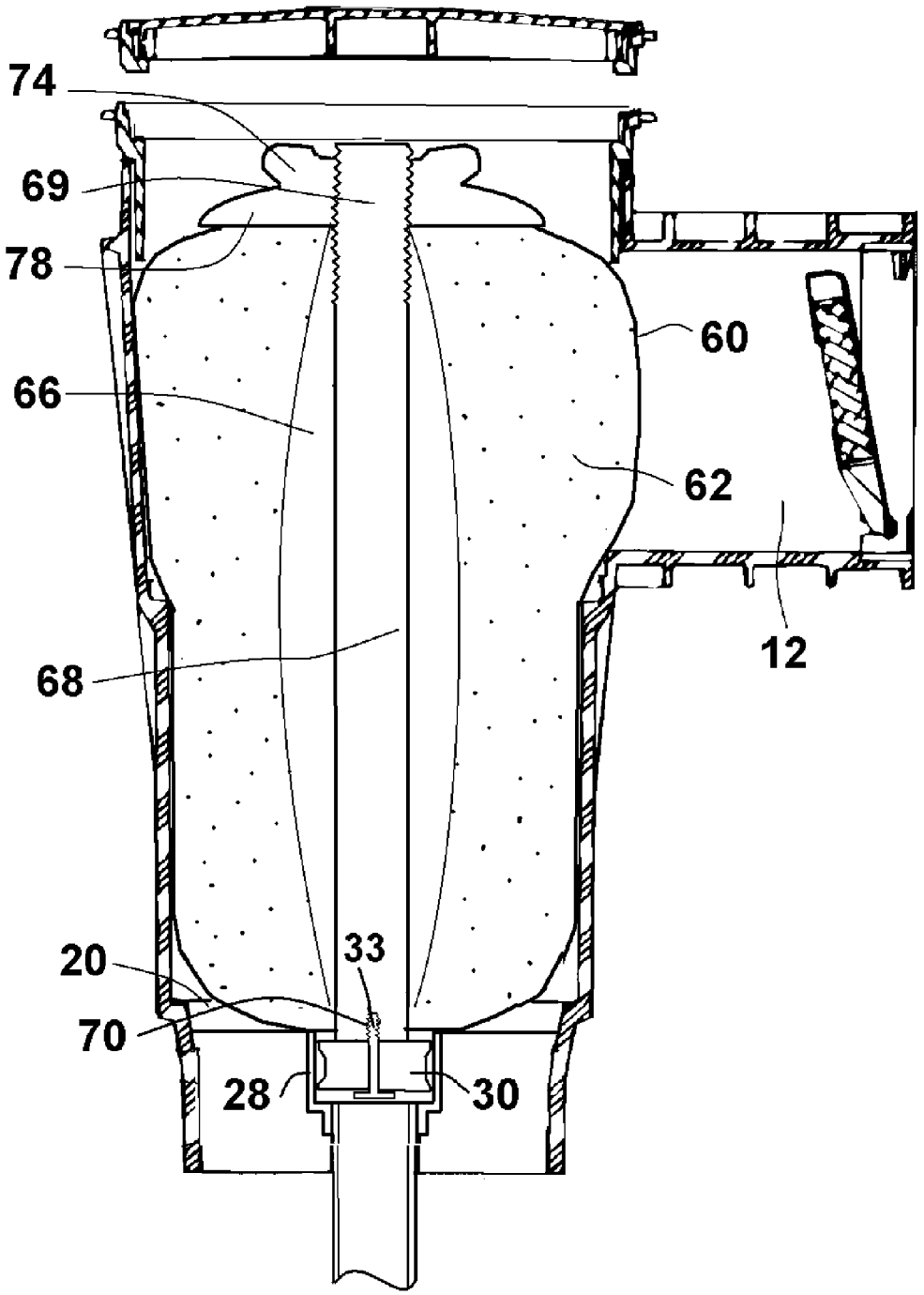
FIG. 7 is a view of the third embodiment of FIG. 5 engaging the prior art skim filter port.

Referring to FIG. 6 in conjunction with FIG. 7, an alternate embodiment of the present invention plug device 60 is shown. In this embodiment, an expandable body 62 is provided that is not inflatable. The expandable body 62 is narrower than the vertical well 20 of the skim filter port 10. As such, the expandable body 62 can readily drop into the vertical well 20. The expandable body 62 is preferably a mass of elastomeric foam or a mass of a low density synthetic rubber. The expandable body 62 is tubular in shape, having a top end 64, a bottom end 65, and an open conduit 66 that extends from the top end 64 to the bottom end 65.

A compression shaft 68 is provided. The compression shaft 68 has a threaded top end 69, a threaded bore 71 at its bottom end 70. A midsection 72 that extends between the threaded top end 69 and the bottom end 70. The compression shaft 68 is extended through the open conduit 66 of the expandable body 62. A head element 74 is provided. The head element 74 is annular in shape and has an internally threaded opening 76 that engages the threaded top end 69 of the compression shaft 68. The head element 74 also has a wide base flange 78 that rests atop the top end 64 of the expandable body 62. The base flange 78 is shown as part of the head element 74. However, it should be understood that the base flange 78 can be a separate washer that passes over the compression shaft 68 above the expandable body 62 and below the head element 74.

In order to utilize the plug device 60, the compression shaft 68 and the expandable body 62 are placed inside the vertical well 20 of the skim filter port 10. The head element is then partially tightened onto the top end 69 of the compression shaft 68. The head element 74 is turned so that the compression shaft 68 turns. As the compression shaft 68 turns, the threaded bore 71 engages the elastomeric plug assembly 30 within pipe intake port 28. Once seated in the pipe intake port 28, the head element 74 is further turned. The head element 74 will move down the compression shaft 68 as it is turned, due to the threaded interconnection between the head element 74 and the compression shaft 68. As the head element 74 is tightened onto the compression shaft 68, the base flange 78 begins to compress the expandable body 62. As the expandable body 62 is compressed vertically, it expands horizontally and fills most all of the space within the vertical well 20. Furthermore, it expands into the horizontal opening 12, therein fully obstructing the horizontal opening 12. As such, little or no water is capable of filling the vertical well 20. If any water were to enter the vertical well 20, that water would have very little volume because there is no area into which the water can flow and collect. If any water were to make it under the plug device 60, that water could not float the plug device 60 out of the vertical well 20 because the plug device 60 is mechanically engaged with the pipe intake port 28 at the bottom of the vertical well 20.

The result is a plug device 60 that conforms to the shape of many different skim filter ports. Furthermore, the plug device 60 is mechanically engaged with the pipe intake port 28 at the bottom of the vertical well 20. This prevents the plug device 60 from being buoyantly displaced from the vertical well 20 even if the entire skim filter port 10 were submerged in rainwater or flood water. Lastly, the plug device 60 is easily installed by simply threading the bottom end 70 of the compression shaft 68 into the pipe intake port 28 at the bottom of the vertical well 20.

Figure 8:
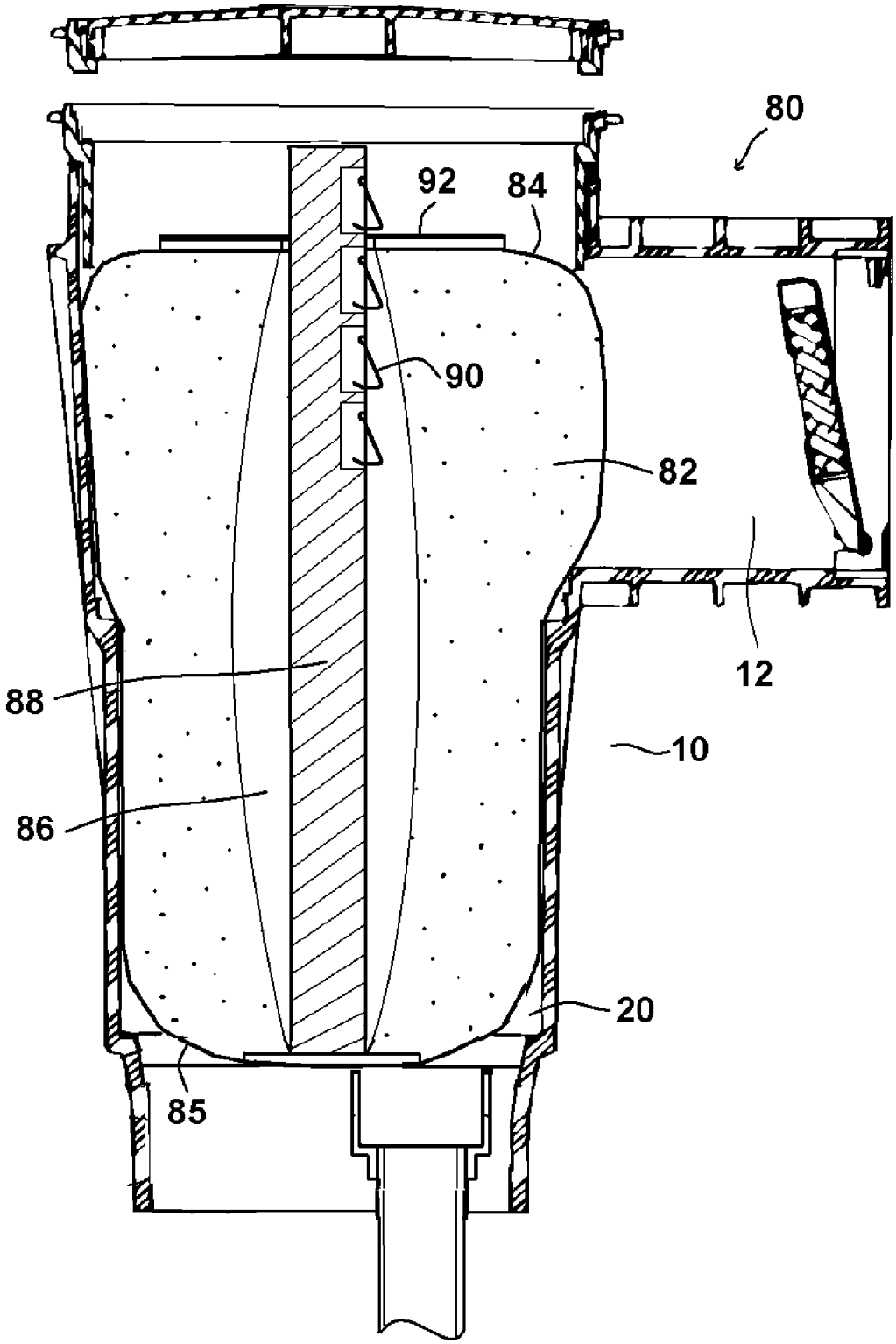
FIG. 8 is a cross-sectional view of a fourth embodiment of a plug device shown in conjunction with the prior art skim filter port of FIG. 1.

Referring to FIG. 8, an alternate embodiment of the present invention plug device 80 is shown. In this embodiment, an expandable body 82 is provided that is not inflatable. The expandable body 82 is narrower than the vertical well 20 of the skim filter port 10. As such, the expandable body 82 can readily drop into the vertical well 20. The expandable body 82 is preferably a mass of elastomeric foam or a mass of a low density synthetic rubber. The expandable body 62 is tubular in shape, having a top end 84, a bottom end 85, and an open conduit 86 that extends from the top end 84 to the bottom end 85.

A compression shaft 88 is provided. The compression shaft 68 has at least one spring loaded clip 90 proximate its top end 69. The compression shaft 88 is extended through the open conduit 86 of the expandable body 82. A head plate 92 is provided. The head plate 92 is annular in shape and has a central opening 94 that passes around the compression shaft 68 as the head plate 92 rests atop the expandable body 82.

In order to utilize the plug device 80, the compression shaft 88 and the expandable body 82 are placed inside the vertical well 20 of the skim filter port 10. The head plate 92 is then pressed against the top of the expandable body 82. The head plate 92 passes the spring clips 90 as it advances down the compression shaft 88. As the head plate 92 compresses the expandable body 82, the expandable body 82 expands horizontally and fills most all of the space within the vertical well 20. Furthermore, it expands into the horizontal opening 12, therein fully obstructing the horizontal opening 12. As such, little or no water is capable of filling the vertical well 20. The result is a plug device 80 that conforms to the shape of many different skim filter ports.

In the embodiment of FIG. 8, the pipe intake port 28 is offset and does not align with the compression shaft 88. However, the friction between the expandable body 82 and the vertical well 20 is sufficient to keep the plug device 80 from being displaced by water.

Figure 9:
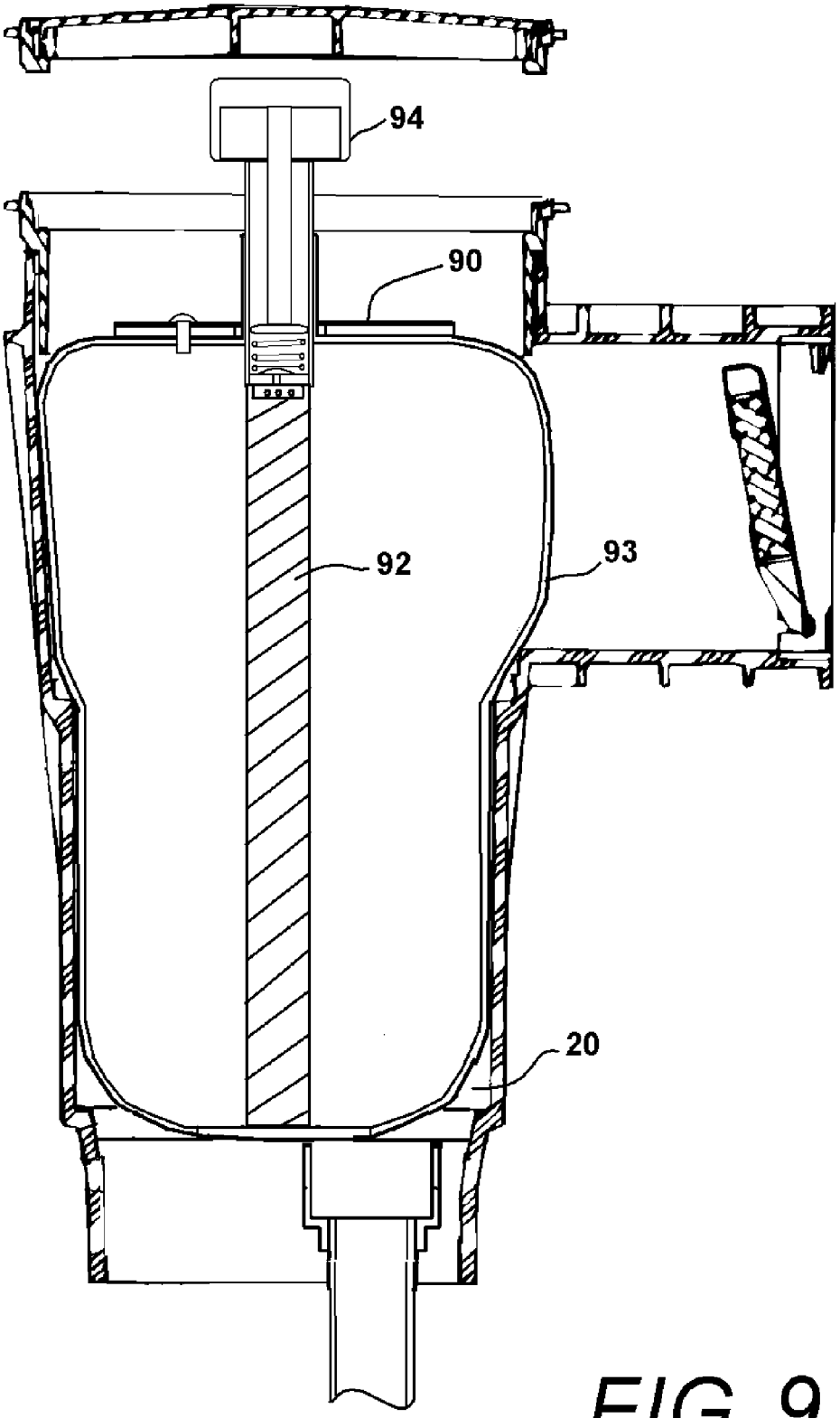
FIG. 9 is a cross-sectional view of a fifth embodiment of a plug device shown in conjunction with the prior art skim filter port of FIG. 1.

Referring lastly to FIG. 9, an alternate embodiment of the present invention plug device 90 is shown. In this embodiment, an expandable body 92 is provided that is inflatable. The expandable body 92 is dropped into the vertical well 20.

A shaft 92 is present inside the expandable body 93. The shaft 93 supports a hand pump 94. The hand pump 94 can be manually manipulated to inflate the expandable body 93.

In order to utilize the plug device 90, the expandable body 92 is placed inside the vertical well 20 of the skim filter port 10. The expandable body 92 is the inflated with the hand pump 94. As it inflates, the expandable body 92 expands horizontally and fills most all of the space within the vertical well 20. The result is a plug device 90 that conforms to the shape of many different skim filter ports.

To remove the plug device 90, a release valve 96 is provided. When pressed, the release valve 96 vents the expandable body 92 and the expandable body deflates.

It will be understood that the embodiments of the present invention that are illustrated and described are merely exemplary and that a person skilled in the art can make many variations to those embodiments. For instance, the expandable body of the embodiment of FIGS. 6, 7 and 8 can be formed as an inflatable bladder having an inflation nipple, such as with the earlier embodiment of FIGS. 4 and 5. Likewise, the length and width of all components in the various embodiments can be altered to fit the skim filter ports of differing depths and widths. All such embodiments are intended to be included within the scope of the present invention as defined by the claims.

What is claimed is:

1. In a swimming pool application having a filtration system that utilizes a skim filter port having a vertical well, a horizontal opening extending from said vertical well, and an intake port that is accessible within the vertical well, a method for preventing water from gathering within said vertical well, said method comprising the steps of:

providing an expandable port plug;

inserting said expandable port plug into said intake port within said vertical well;

providing an inflatable body having a threaded shaft that extends from said inflatable body, wherein said inflatable body expands when inflated;

inserting said inflatable body into said vertical well, wherein said threaded shaft on said inflatable body engages said expandable port plug;

rotating said inflatable body within said vertical well to expand said expandable port plug in said intake port; and inflating said inflatable body within said vertical well to fill most of said vertical well.

2. The method according to claim 1, wherein said threaded shaft engages said expandable port plug within said intake port with a threaded connection.

3. The method according to claim 1, wherein said step of providing an inflatable body includes providing said inflatable body with said threaded shaft extending through said expandable body.

4. A method for preventing water from gathering in a vertical well of a skim filter port, wherein an intake port is disposed within said vertical well, said method comprising the steps of:

providing an expandable port plug;

inserting said expandable port plug into said intake port within said vertical well;

providing a plug assembly having an expandable body and a threaded shaft that extends from said expandable body;

inserting said plug assembly into said vertical well of said skim filter port;

creating a mechanical connection between said threaded shaft and said expandable port plug within said skim filter port; and expanding said expandable body within said vertical well of said skim filter port to plug said skim filter port.

5. The method according to claim 4, wherein said step of providing a plug assembly includes providing a plug assembly with an inflation nipple that is coupled to said expandable body.

6. The method according to claim 5, wherein said step of expanding said expandable body includes inflating said expandable body by introducing air through said inflation nipple.

7. The method according to claim 4, wherein said step of providing a plug assembly includes providing a plug assembly with a handle element to facilitate manually grasping and rotating said plug assembly.

8. The method according to claim 4, wherein said step of providing a plug assembly includes providing an inflatable expandable body having a threaded shaft affixed to said inflatable expandable body.

9. The method according to claim 4, wherein said step of providing a plug assembly includes providing an expandable body having a threaded shaft that extends through said expandable body.

* * * * *